US010012483B1

(12) United States Patent
Little

(10) Patent No.: US 10,012,483 B1
(45) Date of Patent: Jul. 3, 2018

(54) METHOD FOR RECOVERY OF FIREARM-DISCHARGED PELLETS

(71) Applicant: Joseph McGraw Little, Raleigh, NC (US)

(72) Inventor: Joseph McGraw Little, Raleigh, NC (US)

(73) Assignee: Blake Terence Williams, Columbia, SC (US), 50% of the right, title, and interest ( * ) Notice: Subject to any disclaimer, the term of this patent is extended or adjusted under 35 U.S.C. 154(b) by 0 days.

(21) Appl. No.: 15/673,499

(22) Filed: Aug. 10, 2017

Related U.S. Application Data

(62) Division of application No. 15/157,733, filed on May 18, 2016.

(51) Int. Cl.
*F41J 13/00* (2009.01)

(52) U.S. Cl.
CPC ..... *F41J 13/00* (2013.01)

(58) Field of Classification Search
CPC ..... D04H 13/00; D04H 13/01; D04H 13/006
USPC ..... 273/403–410
See application file for complete search history.

(56) References Cited

U.S. PATENT DOCUMENTS 2,397,921 A * 4/1946 Cole ..... F41J 13/02 273/410
3,122,367 A * 2/1964 Dale ..... F41J 13/02 273/394
3,319,960 A * 5/1967 Wilcox ..... F41J 5/00 273/404
3,595,731 A 7/1971 Davies et al.
3,720,411 A * 3/1973 DeVogelaere ..... F41J 13/02 273/404
3,902,721 A 9/1975 Piccini
4,076,246 A * 2/1978 Meyer ..... F41J 3/0004 273/404
4,695,060 A * 9/1987 Pilgrim ..... F41J 3/0004 273/404

(Continued)

OTHER PUBLICATIONS

Kim, Yong. K and Lewis, Armand F., "Lead Shot Fabrics and Curtain Systems for Mitigating Lead Contamination at Shooting Ranges", College of Engineering University of Massachusetts-Dartmouth, MA, all enclosed pages cited.

(Continued)

*Primary Examiner* — Mark Graham
(74) *Attorney, Agent, or Firm* — Nelson Mullins Riley & Scarborough LLP

(57) ABSTRACT

A sheet material characterized by an ability to capture and retain generally-spherical firearm-discharged pellets when struck thereby. The sheet material basically comprises a forward strike face, a rearward back face, and an embedment region therebetween. The strike face is penetrable by the pellets, and the sheet material has a structure adapted to disperse kinetic energy in the pellets upon penetration to cause the pellets to embed within the embedment region without exiting the rearward back face. The sheet material may advantageously be deployed as a curtain at a firearm shooting range in a selected disposition to capture and retain firearm-discharged pellets, thereby to abate environmental contamination from pellets collecting on the grounds of shooting ranges.

5 Claims, 1 Drawing Sheet

(56) References Cited

U.S. PATENT DOCUMENTS 4,819,946 A * 4/1989 Kahler ..... F41J 13/00 273/404
4,856,791 A * 8/1989 McQuade ..... F41J 13/00 273/410
D329,680 S * 9/1992 Burn ..... D22/113
5,393,313 A 2/1995 Reiger
5,496,039 A 3/1996 Lammuto
5,567,498 A * 10/1996 McCarter ..... B29C 59/046 2/2.5
6,526,861 B1 * 3/2003 Gruber ..... F41J 13/00 273/410
7,434,810 B2 * 10/2008 DeMille ..... A63F 9/0204 273/403
7,494,128 B2 2/2009 Byram et al.
7,851,388 B2 12/2010 Kim et al.
8,124,175 B2 2/2012 Kim et al.
8,550,466 B2 * 10/2013 Priebe ..... F41J 13/00 273/410
8,931,781 B2 * 1/2015 Dreiband ..... F41J 13/02 273/404
9,726,464 B2 * 8/2017 Moberg ..... F41J 13/00
2003/0114064 A1 * 6/2003 Fu ..... B32B 5/26 442/239
2010/0215953 A1 * 8/2010 Boussu ..... F41H 5/0485 428/340
2013/0087974 A1 * 4/2013 Chu ..... F41J 3/00 273/348
2013/0187336 A1 7/2013 Dreiband
2013/0249168 A1 * 9/2013 Kepple ..... F41H 5/04 273/408
2014/0054859 A1 2/2014 Kantor

OTHER PUBLICATIONS

Welcome to ShotStop, http://www.shot-stop.com/, 2012-2015 (accessed on Mar. 17, 2016), all enclosed pages cited.

* cited by examiner

METHOD FOR RECOVERY OF FIREARM-DISCHARGED PELLETS

CROSS-REFERENCE TO RELATED APPLICATION

This is a division of and claims priority from co-pending U.S. patent application Ser. No. 15/157,733, filed May 18, 2016, entitled SHEET MATERIAL FOR USE AS A CURTAIN FOR CAPTURING AND RETAINING FIREARM-DISCHARGED PELLETS AND METHOD FOR RECOVERY OF FIREARM-DISCHARGED PELLETS THEREWITH, the entire contents of which are incorporated herein by reference.

BACKGROUND OF THE INVENTION

The present invention relates generally to shooting sports utilizing firearms which discharge generally spherical pellets or "shot", commonly referred to as shotguns, and, more particularly, to means and methods for collection and recovery of spent pellets at shooting ranges.

Shotgun sportsmen commonly practice their shooting skills as well as hold competitions at skeet, trap, sporting clay and other shooting ranges. The shotgun pellets or "shot" discharged by such firearms are largely comprised of lead, which is recognized to pose environmental as well as health hazards. Over time, the spent shotgun pellets discharged at shooting ranges progressively collect on and contaminate the grounds of shooting ranges, requiring periodic remediation or abatement of the contamination and devaluing the desirability and usefulness of the land for other purposes. Moreover, shotgun pellets that may be collected from the grounds for recycling and reuse are also devalued by impurities resulting from co-mingling with soil, vegetation and the like.

These environmental consequences have received increasing attention over recent years among firearms sporting organizations, firearms manufacturers, and governmental agencies responsible for environmental matters. To address such concerns, it has been proposed to erect so-called "curtain" devices at shooting ranges to intercept discharged shotgun pellets and redirect the pellets to fall into a trough or other collection container. Examples of such curtain devices are disclosed in U.S. Pat. Nos. 7,851,388 and 8,124,175. Such devices represent an important step forward in abating the environmental contamination occurring at shooting ranges, but the devices are relatively expensive. Hence, the need continues to exist for a simplified, reliable and inexpensive means of capturing shotgun pellets at shooting ranges.

SUMMARY OF THE INVENTION

The present invention provides a novel sheet material characterized by an ability to capture and retain generally-spherical firearm-discharged pellets when struck thereby. The sheet material basically comprises a forward strike face, a rearward back face, and an embedment region therebetween. The strike face is penetrable by the pellets, and the sheet material has a structure adapted to disperse kinetic energy in the pellets upon penetration to cause the pellets to embed within the embedment region without exiting the rearward back face. The sheet material may advantageously be deployed as a curtain at a firearm shooting range in a selected disposition to capture and retain firearm-discharged pellets when struck thereby.

Various embodiments of the sheet material are contemplated to be possible. In one embodiment, the sheet material may be a textile fabric. For example, the textile fabric may have a non-woven structure comprised of textile fibers integrated randomly in a textile structure, such as a structure formed by needle-punched staple fibers. The textile fibers in such a non-woven textile structure define interstices in the strike face of the fabric penetrable by the pellets. The textile fibers at the strike face of the textile structure may be bonded to one another, e.g., by calendaring to thermally bond the fibers at the strike face of the textile structure.

The deployment of the sheet material at a firearm shooting range facilitates an advantageous method for recovery of firearm-discharged pellets by erecting a curtain of the sheet material at the firearm shooting range in a disposition to capture and retain the firearm-discharged pellets. The embedded pellets captured in the sheet material may then be harvested for recycling and reuse, e.g., by manipulating the textile fabric or other sheet material to eject the pellets.

DETAILED DESCRIPTION OF THE INVENTION

Figure 1:
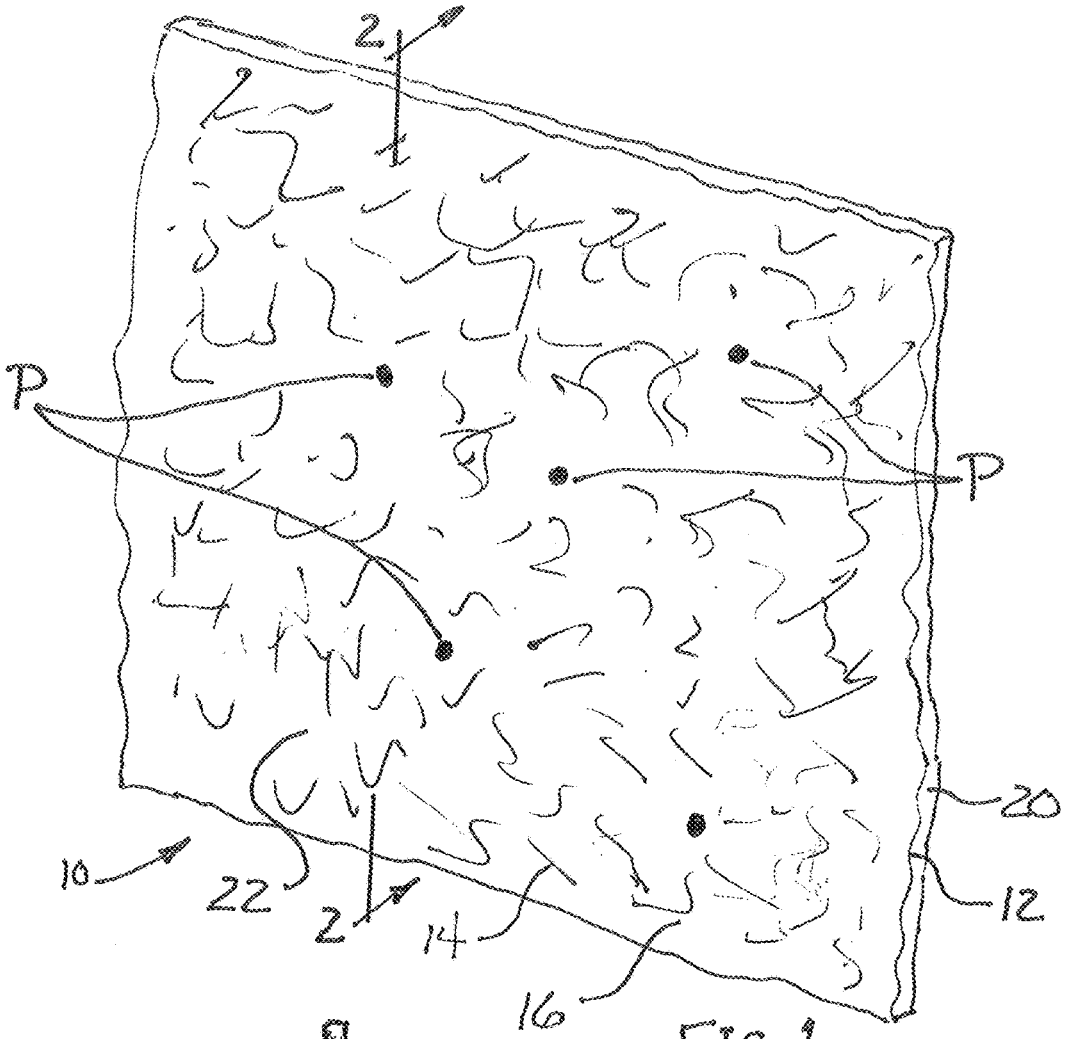
FIG. 1 is a front perspective view of a sheet material according to one contemplated embodiment of the present invention.
Figure 2:
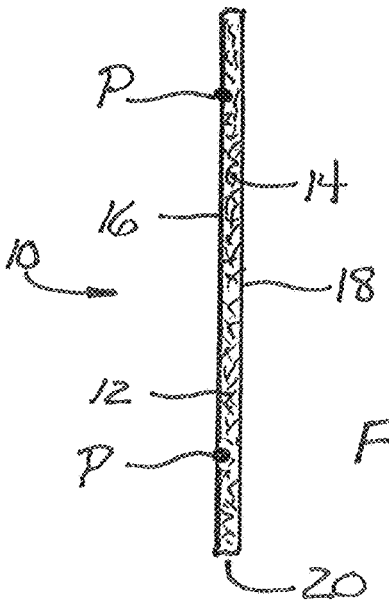
FIG. 2 is a cross-sectional view through the sheet material of FIG. 1, taken along line 2-2 thereof.

Referring now to the accompanying drawings, a representative contemplated embodiment of a sheet material in accordance with the present invention is indicated generally at 10 in the form of a nonwoven textile fabric. However, as will be appreciated by persons skilled in the art and as more fully explained hereinafter, many various alternative embodiments of sheet materials are also contemplated within the scope and concept of the present invention, and it is to therefore be expressly understood that the present invention is not intended nor to be construed as limited to the embodiment of the sheet material 10.

The nonwoven textile fabric sheet material 10 basically comprises a textile structure 12 composed of staple-length textile fibers 14 joined via a known needle-punch process wherein a mass of the fibers 14 are repetitively penetrated via multiple barbed needles to frictionally consolidate and integrate the fibers 14 randomly into a generally planar web form. The resultant textile structure 12 has a three-dimensional mass and thickness 20 between opposing generally parallel forward and rearward faces 16, 18, respectively, with random interstices 22 between the constituent fibers 14 at both faces 16, 18 and within the thickness 20.

In the depicted embodiment, the textile fibers 14 comprise a blend of 8 denier staple-length polypropylene fibers and 6 denier staple-length polyester fibers needle-punched to a thickness of 5.5 mm (0.22 inches) and a relaxed, uncompressed density of 28 ounces per square yard. Following needle-punch formation, the textile structure 12 is subjected to a single calendaring process on the forward face 16 at which the needle-punch needles penetrate and withdraw, thereby thermally bonding the staple fibers 14 thereat. The resultant textile structure 12 has a grab tensile strength of about 670 pounds and elongation of about 84% as measured by ASTM Test Methodology D 4632, rod puncture strength of about 300 pounds as measured by ASTM Test Methodology D 4833, and CBR (California bearing ratio) puncture strength of about 2200 pounds as measured by ASTM Test Methodology D 6241.

In contemplated use, the textile structure 12 is deployed as a curtain in a disposition at a firearm shooting range with the forward face 16 facing the direction of expected discharge of a shotgun to serve as a strike face of the sheet material 10 and the thickness 20 to serve as an embedment region to intercept and retain the generally-spherical pellets P discharged by such a firearm. In preliminary testing of the textile structure 12, shotgun pellets of standard size #6 shot discharged to strike the forward face 16 from a distance of 75 feet penetrated the interstices 22 at the forward face 16 but the kinetic energy of the pellets P was dispersed and dissipated without the pellets reaching or exiting the rearward face 18 causing them to become embedded within the central thickness 20 of the textile structure 12.

As previously noted, various alternative embodiments are contemplated. For example, but without limitation, the fabric embodiment described above is contemplated to be equally functional and effective to capture and retain shotgun-discharged pellets P if disposed with the rearward non-calendared face 18 disposed to face in the direction of expected discharge of a shotgun to serve as the strike face of the sheet material 10. Similarly, the above-described fabric embodiment is also contemplated to be equally functional and effective for capture of discharged pellets P without calendaring or other heat bonding of the fibers at the forward strike face 16 of the textile structure 12.

Other embodiments of the sheet material 10 may be made of other synthetic or natural textile fibers and in other fiber sizes having sufficient tensile strength and physical properties effective to absorb and dissipate the kinetic energy of discharged shotgun pellets. As the sheet material 10 will often be deployed in an outdoor setting, it is also contemplated to be important that the fibers be resistant to degradation from long-term exposure to ultraviolet light. Contemplated alternative fibers may include but are not limited to polyamides, polyethylenes, acrylics, burlaps, jutes, wools, cottons, and blends thereof. Likewise, it is contemplated that the textile fibers may be continuous filament instead of staple length fibers, could be monofilament or multifilament, and could be of varying cross-sectional shapes.

It is further contemplated that the non-woven fabric structure 12 could be made by other non-woven fabric-forming methodologies, e.g., spun bonding, a melt-blown process, water jet entanglement, or other known or newly developed non-woven processes. Alternatively, other embodiments of sheet material 10 could be made of other textile structures, e.g., knitted or woven structures, or of non-textile materials and structures, so long as having a forward strike face, a rearward back face, and an embedment thickness therebetween adapted to disperse kinetic energy when penetrated by discharged shotgun pellets so as to capture and retain the pellets within the embedment thickness without exiting the rearward back face.

Other physical parameters of the sheet material 10, e.g., the thickness 20 thereof, the weight per unit dimension and density, may be varied. Other fabric treatments or additives are also possible. For example, instead of calendaring to thermally bonded fibers at the forward strike face 16, a resin or other chemical finish could be applied to the forward and/or rearward face 16, 18 of the sheet material 10.

These and other modifications and alternative in the embodiments of the sheet material 10 may be selected and adjusted according to variables in the intended uses and applications of the sheet material 10, e.g., according to the intended distance at which the sheet material 10 is deployed from the expected point of firearm discharge, differing sizes and gauges of discharged pellets, and differing shotgun cartridges producing different discharge velocities. The adjustment of such variables is believed to be within the level of skill of a person skilled in the relevant art.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for recovery of generally-spherical shotgun discharged pellets from a shotgun shooting range, comprising the steps of (a) fabricating a sheet material characterized by an ability to capture and retain generally-spherical shotgun discharged pellets when struck thereby, the sheet material comprising a forward strike face, a rearward back face, and an embedment region therebetween, the strike face being penetrable by the pellets, and the sheet material having a structure adapted to disperse kinetic energy in the pellets upon penetration for embedment of the pellets within the embedment region without exiting the rearward back face, wherein the sheet material is a textile fabric of a non-woven structure comprised of textile fibers integrated randomly in a textile structure defining interstices in the strike face penetrable by the pellets; and (b) erecting a curtain of the sheet material at the shotgun shooting range in a disposition to form a backdrop to shotgun discharges with the forward strike face arranged to face the shotgun shooting range and the rearward back face facing away from the shotgun shooting range so as to intercept discharged generally-spherical shotgun-discharged pellets to capture and retain the firearm-discharged pellets within the embedment region of the sheet material.

2. A method for recovery of firearm-discharged pellets according to claim 1, wherein the step of forming the textile fabric comprises needle-punching staple fibers.

3. A method for recovery of firearm-discharged pellets according to claim 1, wherein the step of forming the textile fabric comprises calendaring the strike face of the textile structure.

4. A method for recovery of firearm-discharged pellets according to claim 1, further comprising the step of harvesting embedded pellets from the textile fabric.

5. A method for recovery of firearm-discharged pellets according to claim 1, wherein the step of harvesting the pellets comprises manipulating the textile fabric to eject pellets.

* * * * *